US012262815B2

(12) United States Patent
Nilsson et al.

(10) Patent No.: US 12,262,815 B2
(45) Date of Patent: Apr. 1, 2025

(54) HANG STANDARD AND STORAGE SYSTEM INCLUDING THE HANG STANDARD

(71) Applicant: Elfa International AB, Västervik (SE)

(72) Inventors: Peter Nilsson, Västervik (SE); Tobias Ringenhag, Västervik (SE)

( * ) Notice: Subject to any disclaimer, the term of this patent is extended or adjusted under 35 U.S.C. 154(b) by 0 days.

(21) Appl. No.: 18/438,514

(22) Filed: Feb. 11, 2024

(65) Prior Publication Data

US 2024/0260756 A1 Aug. 8, 2024

Related U.S. Application Data

(63) Continuation of application No. 17/246,544, filed on Apr. 30, 2021, now Pat. No. 11,910,927.

(30) Foreign Application Priority Data

Apr. 30, 2020 (SE) ..... 2050499-9

(51) Int. Cl.
*A47B 96/14* (2006.01)
*A47B 96/06* (2006.01)

(52) U.S. Cl.
CPC ..... *A47B 96/1408* (2013.01); *A47B 96/061* (2013.01)

(58) Field of Classification Search
CPC . A47B 96/1408; A47B 96/061; A47B 96/067; A47B 96/027; A47B 96/07; A47B 47/00; A47B 47/022; A47B 57/42; A47B 96/1441; A47F 5/08
See application file for complete search history.

(56) References Cited

U.S. PATENT DOCUMENTS 3,396,499 A * 8/1968 Biffani ..... E04B 1/2403 52/845
3,510,010 A * 5/1970 Gasner ..... F16B 7/22 248/248
3,765,344 A * 10/1973 Ferdinand ..... A47B 45/00 108/182
4,069,638 A * 1/1978 Hasselqvist ..... E04C 3/07 403/312

(Continued)

FOREIGN PATENT DOCUMENTS

GB 2169791 A * 7/1986 ..... A47B 96/1416
JP 2011072551 4/2011

(Continued)

OTHER PUBLICATIONS

Extended European Search Report issued in EP21795738 dated Apr. 15, 2024, 7 pages.

(Continued)

*Primary Examiner* — Devin K Barnett
(74) *Attorney, Agent, or Firm* — Hubbard Law, PLLC; Marc Hubbard

(57) ABSTRACT

A hang standard, for mounting vertically and connecting with cantilevered brackets, is elongated and has an approximately U-shaped cross-section with a front portion and two rearwards extending leg portions. The front portion comprises a plurality of slots located in a recess between first and second protruding portions, which are located on first and second side of the slots. The recess is laterally continuous from the first to the second protruding portion and over two columns of slots.

4 Claims, 5 Drawing Sheets

(56) References Cited

U.S. PATENT DOCUMENTS 4,411,400 A * 10/1983 Everett ..... A47B 57/42 248/216.1
5,004,198 A * 4/1991 Jager ..... A47F 5/106 248/224.8
5,110,080 A * 5/1992 Rieman ..... A47B 96/1408 248/225.11
5,135,194 A * 8/1992 Laughon ..... A47B 95/008 248/243
D342,015 S * 12/1993 Andrejew ..... D8/373
5,269,619 A * 12/1993 Warkus ..... F16B 7/0473 403/255
5,348,385 A * 9/1994 Berg ..... A47B 57/04 211/187
5,377,851 A * 1/1995 Asano ..... A47B 57/402 211/192
D361,631 S * 8/1995 King ..... D25/128
5,540,340 A * 7/1996 Betteley ..... A47B 96/1475 211/183
5,638,644 A * 6/1997 Bastian ..... B01L 9/02 52/656.1
6,109,461 A * 8/2000 Kluge ..... A47B 57/30 211/187
6,112,913 A * 9/2000 Rindoks ..... A47B 57/30 312/247
6,363,643 B1 * 4/2002 Padiak ..... G09F 7/20 40/642.01
D490,697 S * 6/2004 Runnalls ..... D8/380
D493,641 S * 8/2004 Brazier ..... D6/712
6,932,225 B2 * 8/2005 Rowe ..... A47B 57/30 211/90.02
7,086,543 B2 * 8/2006 Remmers ..... A47H 99/00 211/186
7,086,544 B1 * 8/2006 Doench ..... A47B 96/028 248/222.51
7,188,740 B2 * 3/2007 Marchetta ..... A47B 47/022 211/90.03
7,225,935 B2 * 6/2007 Breymaier ..... A47B 96/067 248/225.11
D550,540 S * 9/2007 Nawrocki ..... D8/354
7,392,911 B2 * 7/2008 Stitchick ..... A47B 96/061 211/90.03
7,427,053 B2 * 9/2008 Nawrocki ..... A47F 5/0006 248/302
7,694,925 B2 * 4/2010 Kokenge ..... A47F 5/0807 248/220.42
8,087,521 B2 * 1/2012 Schwartzkopf ..... A47F 5/101 211/94.01
8,684,195 B1 * 4/2014 Caruso ..... A47B 95/008 211/94.01
9,347,213 B1 * 5/2016 Zhang ..... E04B 1/388
9,683,590 B2 * 6/2017 Zhang ..... F16B 7/0473
9,770,122 B2 * 9/2017 Gonzalez ..... A47B 95/008
9,790,980 B2 * 10/2017 McCarthy ..... F16B 37/045
10,012,255 B2 * 7/2018 Knutson ..... F16L 3/243
10,602,843 B2 * 3/2020 Sisto ..... F16B 47/003
D881,416 S * 4/2020 Jiang ..... D25/122
10,634,279 B2 * 4/2020 Lu ..... F16M 13/02
10,653,239 B2 * 5/2020 Nilsson ..... A47B 96/028
11,253,069 B2 * 2/2022 Kokenge ..... F16B 21/00
11,369,215 B2 * 6/2022 Obitts ..... A47F 5/0043
11,478,080 B2 * 10/2022 Briosi ..... F16B 12/32
11,717,085 B2 8/2023 Nilsson
2003/0042033 A1 * 3/2003 Herb ..... E04C 3/07 174/480
2003/0159397 A1 * 8/2003 Birnbaum ..... E04C 3/07 52/843
2004/0007550 A1 * 1/2004 Leeman ..... A47F 5/101 211/187
2005/0145588 A1 * 7/2005 Stitchick ..... A47B 96/061 211/183
2005/0150850 A1 * 7/2005 Stitchick ..... A47B 47/022 211/90.03
2007/0023375 A1 * 2/2007 Fedewa ..... F16M 11/046 211/102
2007/0120036 A1 * 5/2007 Olle ..... F24F 13/0254 248/615
2007/0221595 A1 * 9/2007 Chen ..... A47B 95/008 211/207
2007/0221597 A1 * 9/2007 Chen ..... A47B 57/40 211/192
2008/0116329 A1 * 5/2008 Magnusson ..... A47F 5/103 248/158
2008/0237426 A1 * 10/2008 Walters ..... H04N 5/64 248/304
2012/0255925 A1 * 10/2012 Fernandez ..... A47B 96/067 211/134
2014/0260083 A1 * 9/2014 Zhang ..... F16M 13/027 52/843
2017/0112282 A1 * 4/2017 Will ..... A47B 96/067
2018/0132610 A1 * 5/2018 Lu ..... A47B 57/42
2018/0352953 A1 * 12/2018 Nilsson ..... A47B 95/04
2020/0113329 A1 * 4/2020 Nilsson ..... F16B 7/0473
2021/0337967 A1 * 11/2021 Nilsson ..... A47B 96/1441
2024/0016293 A1 1/2024 Nilsson

FOREIGN PATENT DOCUMENTS

WO 8907409 8/1989
WO 9216126 10/1992
WO 2017070175 4/2017

OTHER PUBLICATIONS

Extended European Search Report issued in EP21796254 dated Jul. 9, 2024, 10 pages.
Office Action (Non-Final Rejection) dated Apr. 18, 2024 for U.S. Appl. No. 18/349,926 (pp. 1-9).
Office Action (Non-Final Rejection) dated Jul. 22, 2022 for U.S. Appl. No. 17/246,442 (pp. 1-17).

* cited by examiner

HANG STANDARD AND STORAGE SYSTEM INCLUDING THE HANG STANDARD

RELATED APPLICATIONS

This application is a continuation of U.S. application Ser. No. 17/246,544, filed Apr. 30, 2021, which claims priority to Swedish Application No. 2050499-9, filed Apr. 30, 2020, both of which are incorporated herein in their entirety for all purposes.

FIELD OF INVENTION

The present invention relates to a hang standard for mounting vertically in a storage system and connecting with cantilevered brackets and the like, the standard being elongated and having an approximately U-shaped cross-section with a front portion and two rearwards extending leg portions, the front portion comprising a plurality of slots as connection points and being located in a recess between first and second protruding portions, located on first and second side of the slots, respectively.

BACKGROUND

WO2019/083632 A1 discloses a wall-mounted storage system, which comprises a plurality of hang standards for vertical mounting on a wall or the like. The hang standards provide a support for cantilevered brackets, which in their turn support various storage components, such as shelves, baskets, drawers, etc. Each of the brackets utilizes slots in a single column of slots in the hang standard for inserting hooks to hang a bracket therein. The hang standard has a cross-section where each column of slots on a front face of the hang standard is recessed to obtain a visually attractive appearance, the slots being at least partly obscured by protruding portions. Brackets with attachment hooks arranged in parallel, which have been known and widely used for many years, are not compatible with such hang standards.

SUMMARY

Disclosed are representative examples of hang standards that are compatible with brackets with parallel attachment hooks and embody various aspects that can be used alone or in various combinations to provide improved hang standards, solving various problems in the prior art.

According to one aspect, a hang standard has protruding portions on opposite sides of two or more columns of slots, defining between them a recess that is laterally continuous over the two columns of slots. It may work well with different brackets for shelves, drawers, and the like that have been sold and used for several years. Hence, the disclosed hang standard is combinable with components that the end customer may already have or with components that are already available for purchase.

This arrangement allows, optionally, the points at which the connection of brackets to a hang standard or connection points to be located within the recess, between the protruding portions. This allows the connection points and connections between brackets and the hang standard to be at least partially covered or made less conspicuous, thereby resulting in a more visually pleasing appearance when installed.

In another aspect, the bending stiffness of a hang standard with protruding portions is increased by a transition portion extending into a protruding portion, which has an outer lateral wall facing away from the front portion and an inner lateral wall facing towards the front portion, and the outer and inner lateral walls together comprising a double layer of the sheet metal. This provides an increased second moment of area. The high bending stiffness results in a high load-carrying ability while maintaining the shape of the hang standard, both as seen in its longitudinal direction and in its cross-section.

According to yet another, an outwardly extending longitudinal flange at a rear end of each of two leg portions that extend rearwardly from the front of a hang standard can be used to increase the bending stiffness of the hang standard. Additionally, the flanges may optionally, be arranged to be parallel with, and bear against, a wall on which the hang standard may be mounted, thus avoiding contacting the wall with sharp edges that could damage the surface of the wall, for example, paint or wallpaper.

In another aspect, a section of the rearward extending leg portions may be made narrower than the width of a front of a hang standard with protruding portions, thereby forming a ledge at the transition portion between each leg portion and each protruding portion. One advantage of this feature is that a covering screen or board may optionally, be attached between two hang standards by sliding, clamping, or snapping it behind the longitudinal ledge on the respective hang standard.

Furthermore, in embodiments with the protruding portions, the front portion and protruding portions can be, optionally, made to form an undercut recess. The undercut recess can be used to conceal the connection point from view and for snap fastening of various components included in the storage system. In one embodiment of such a recess, an inner lateral wall of each protruding portion is slanted to create the undercut recess. In a further embodiment, each inner lateral wall is arranged with an angle of less than 15° to a respective outer lateral wall of the protruding portion. With a limited angle between the outside and inside lateral walls of the protruding portion, the bending stiffness of the hang standard as a whole is increased, e.g., in comparison with a hang standard without protruding portions. In some preferred embodiments, the angle is 3-12°, preferably 10°.

In another embodiment, a longitudinal rib is provided in the bottom part of the recess between the columns of slots. Hereby, the fit of pre-existing brackets in the disclosed hang standard may be exact or at least improved. The disclosed hang standard may be manufactured in sheet metal with a limited thickness, and the provision of a longitudinal rib between the columns of slots may set the distance between the backside and the front side of the front portion longer than the actual thickness of the sheet metal. From the backside at the bottom of the slots, on the one hand, to the front side of the front portion at the longitudinal rib, on the other, the distance will be greater than the actual thickness of the metal. The difference will be approximately equal to the height of the rib. Hence, it is possible to make the thickness of a thinner plate appear as a thicker plate than was used previously in connection with pre-existing brackets. The longitudinal rib may for example, be embossed in the front portion between the columns of slots. Alternatively, the longitudinal rib can be created by parallel bends of the front portion of the hang standard between the columns of slots.

The hang standards with one or more of the described aspects can be, optionally, manufactured from a single sheet of folded metal.

Various options for mounting a hang standard according to any one or more of these aspects in an upright position on a wall may be provided, in addition to the prior art option of arranging fixing means, such as a screw, through the front portion, as well as engagement devices that are arranged at the rearwards extending leg portions for cooperation means for mounting the hang standard on, for example, a wall.

A hang standard with any of these aspects or features may be used or sold for use in a storage system that includes a plurality of hang standards, mounting means for interaction with each of the standards that are arranged on a wall, a plurality of brackets connected with the standards, and storage components supported by the brackets.

It is noted that combinations of one or more of the foregoing aspects may be embodied by a hang standard and are not limited to the representative embodiments that are illustrated.

All the figures are schematic, not necessarily to scale, and generally only show parts that are necessary to elucidate the embodiments, wherein other parts may be omitted.

DETAILED DESCRIPTION

In the following description, like numbers refer to like elements.

The present disclosure relates generally to improvements to a hang standard for mounting vertically in a storage system and connecting with cantilevered brackets and the like, the standard being elongated and having an approximately U-shaped cross-section with a front portion and two rearwards extending leg portions, the front portion comprising a plurality of slots as connection points and being located in a recess between first and second protruding portions, located on first and second side of the slots, respectively. However, such improvements may also be embodied in a hang standard for mounting vertically in a storage system and connecting with cantilevered brackets and the like, the standard being elongated and having an approximately U-shaped cross-section formed in a single piece from a strip of sheet metal, with a front portion and two rearwards extending leg portions, the front portion comprising a plurality of slots as connection points, wherein between the front portion and each of the leg portions there is provided a transition portion. One or more of the improvements may also be embodied in a hang standard for mounting vertically in a storage system and connecting with cantilevered brackets and the like, the standard being elongated and having an approximately U-shaped cross-section, with a front portion and two rearwards extending leg portions, the front portion comprising a plurality of slots as connection points for cantilevered brackets located in a recess.

Figure 1:
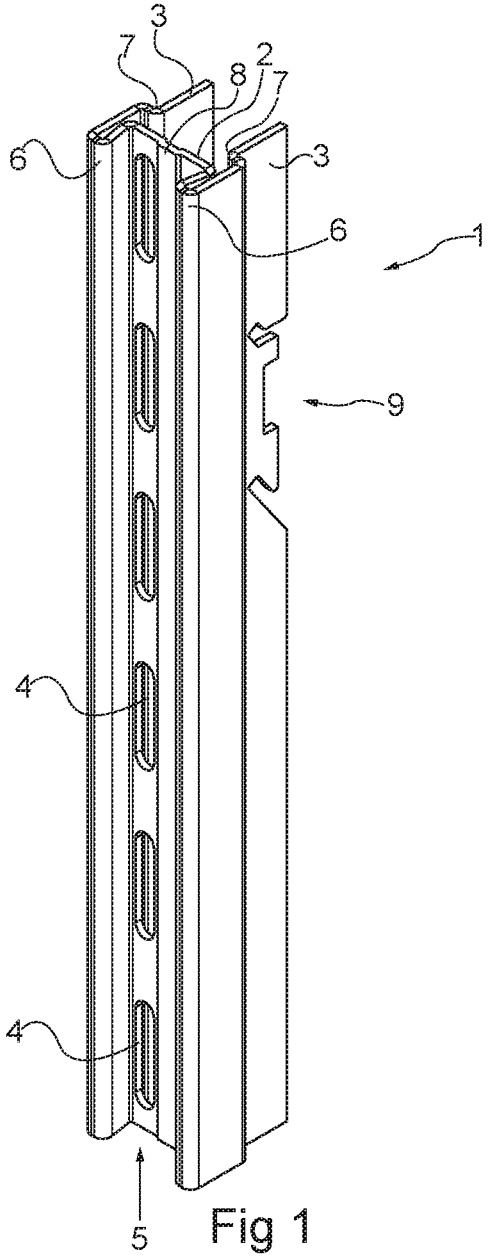
FIG. 1 is a diagrammatic view in perspective of a hang standard.

FIG. 1 illustrates a representative, non-limiting example of a hang standard 1 embodying several features. The hang standard 1 may be comprised as one among many components in a storage system. Several hang standards 1 may be arranged side by side, at suitable distances from one another, vertically, e.g., on a wall. The hang standards 1 are designed to interact with brackets, which in turn carry loads and/or other components in the storage system or directly with other components of the storage system.

The hang standard 1 has a generally U-shaped cross-section with a forwardly facing front portion 2 and two rear leg portions 3, as seen when the hang standard 1 is mounted vertically on a wall. The hang standard 1 may be formed from a single piece of sheet metal by punching and bending in several steps, thereof.

The front portion 2 is provided with a plurality of connection points for brackets at different heights to allow for a selection of the connection point for each bracket used in the system. In the embodiment shown in FIG. 1, the connection points are slots 4 arranged in two columns next to one another. Alternatively, a single column of slots could be substituted and still allow the hang standard to incorporate one or more of the features described below. One of the columns is not visible in FIG. 1 but is clearly shown in FIG. 2. Each slot 4 is arranged next to an identical slot 4 in the other column, thereby providing that the slots 4 are arranged in pairs at different heights. The shown hang standard is rather short for illustrative purposes, having only six slots in each column. Usually, hang standards have tens of slots in each column.

The front portion 2, with the columns of slots 4, is arranged in a recess 5, which is surrounded by protruding portions 6 on each side of the front portion 2. The protruding portions 6 extend forwards from the leg portions 3 via a connecting transition portion 7 on each side of the hang standard 1.

The protruding portions 6 extend slightly outwards from the leg portions 3 at the transition portions 7. In other words, the outer transversal dimension of the hang standard 1 is wider at the protruding portions 6 than at the leg portions 3. Each protruding portion 6 has, in the illustrated embodiment, an outer wall and an inner wall. The double wall can, for example, be formed by bending of the sheet metal making up the hang standard 1.

Figure 2:
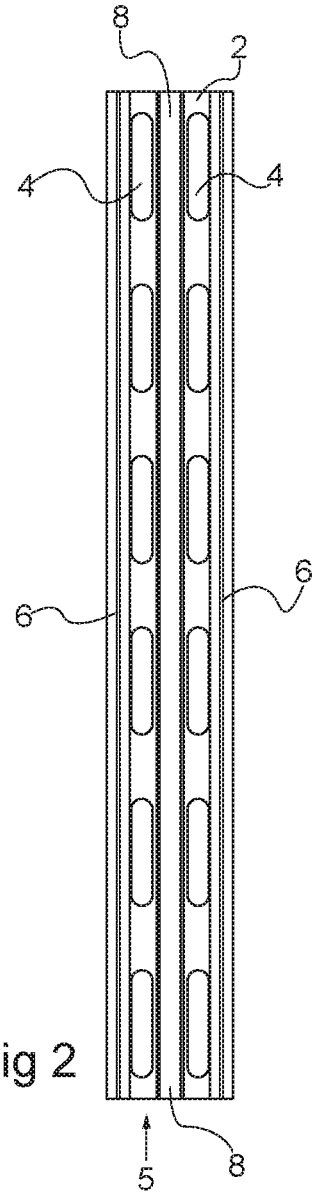
FIG. 2 is a planar view of the hang standard according to FIG. 1.

An optional longitudinal rib 8, best seen in FIG. 2, is provided between the two columns of slots 4. The rib 8 is a narrow area, slightly raised from the surface of the front portion 2. It may be provided by embossing, stamping, bending, etc. of the sheet metal forming the front portion 2. Alternatively, an additional metal strip may be added to make up the rib, which can be, for example, attached by gluing or welding. The forming of the longitudinal rib 8 may take place before the formation of the hang standard 1 by bending or as an intermediate step in the formation process.

One function of the longitudinal rib 8 is to make the front portion 2 thicker for the purpose of connecting brackets designed to be used with hand standards fabricated from thicker sheets of metal. Brackets that were originally designed to fit on hang standards manufactured from a thicker sheet metal may have a correct fit, without play, thanks to the provision of the rib 8. The material thickness in the illustrated case is typically in the range from 1.2-1.8 mm, preferably about 1.6 mm.

A bracket is connected to the hang standard 1 by insertion of hooks into the slots 4. The hooks each open downwards with a width of the opening closely corresponding to the thickness of the sheet metal. Hence, they will come into contact with the outer face of the front portion 2, between the columns of slots 4, as well as with the rear side of the front portion 2, at the lower end region of the slots 4. In the absence of a rib 8, the distance between the outer face and the inner side of the front portion 2, at the respective areas of contact, will correspond to the thickness of the sheet metal. If the thickness of the sheet metal closely matches the opening width of the hook, the fit will be good without play. If the sheet metal is thinner, the distance between the outer face and the inner side of the front portion 2, at the respective areas of contact, may be too small, and the bracket may appear loose. In this case, the addition of rib 8 provides a sufficient elevation for matching the distance between the two areas of contact on the hang standard 1 with the width of the hook opening on the bracket.

In at least one position, as shown in the schematic view of FIG. 1, the leg portions 3 may be provided with an engagement device 9. The engagement device 9 disclosed in FIG. 1 is a series of sockets that are shaped to correspond with a horizontally arranged rail, which will be disclosed in further detail below in connection with FIG. 3B. The sockets 9 will allow the hang standard 1 to be hung from a rail and to be slid sideways into any exact, desired position when the storage system is mounted.

Figures 3A, 3B:
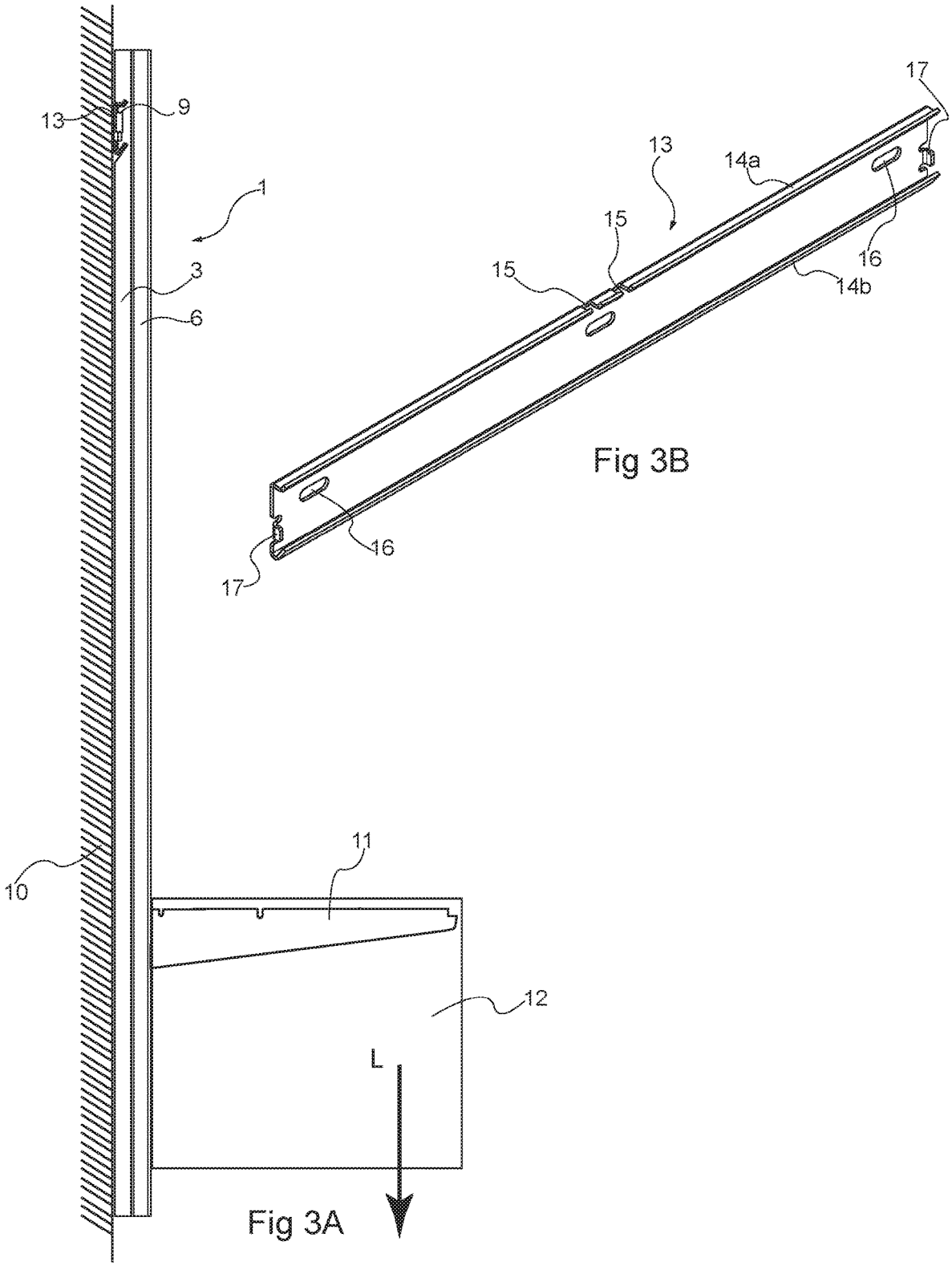
FIG. 3A is a side view of the hang standard according to FIG. 1 mounted on a wall, with a bracket supporting a load.
FIG. 3B is a diagrammatic view in perspective of a rail for mounting the hang standard of FIG. 1 on a wall.

FIG. 3A shows a side view of the hang standard 1 hanging from a horizontal rail 13, which is mounted on a wall 10. The cross-section of the rail 13 corresponds with the shape of the sockets 9, and the hang standard 1 is hanging vertically. A load carrying, cantilevered bracket 11 is attached to at least one of the connection points provided on the front portion 2. A load 12, e.g., a basket or a drawer, is arranged to be supported by the cantilevered bracket 11. Since the size of the load is unpredictable within reasonable limits, and the distribution of the load in the box is unpredictable as well, the load is symbolized by the arrow L in FIG. 3A, which is drawn from an arbitrary center of mass=at a distance from the connection point of the bracket 11 in the hang standard 1. Taking into account a distance between the mass center and the connection point in the hang standard 1, the hang standard 1 is subject to a torque that will tend to bend the standard, with the consequence that the hang standard may not hang snugly against the wall. The hang standard may be made stiffer to resist bending. At the same time, a low weight and limited material consumption are desirable. The disclosed design of the hang standard 1 stiffens the hand standard, making it more resistant to bending under high loads without having to resort to thicker and heavier materials.

FIG. 3B shows the rail 13 in perspective. As seen in FIG. 3A, it is intended for horizontal mounting on a wall 10. As seen in the mounted position, it has an upper 14*a* and a lower 14*b* flange. The upper flange 14*a* is provided with at least one pair of notches 15. The notches 15 are separated by a distance which corresponds to the distance between the leg portions 3 on the hang standard 1. Screw holes 16 are provided for the arrangement of fixing means therein. At each outer end of the rail 13, there is an end tab 17.

The hang standard 1 may be mounted on the horizontal rail 13 by lowering in a vertical direction at the position of the notches 15. The leg portions 3 will each slide in a notch 15 until the lower flange 14*b* has reached its position in the engagement device 9. At this point, the hang standard 1 may be slid in the horizontal direction so that the upper flange 14*a* enters the engagement device 9 sideways. When both the upper 14*a* and the lower 14*b* flanges are in their respective positions, the hang standard 1 cannot be accidentally dismounted, even when it is subjected to an upwards or outwards directed force. The end tabs 17 will act as stops to keep the hang standard 1 from sliding off the rail 13 sideways.

Figure 4:
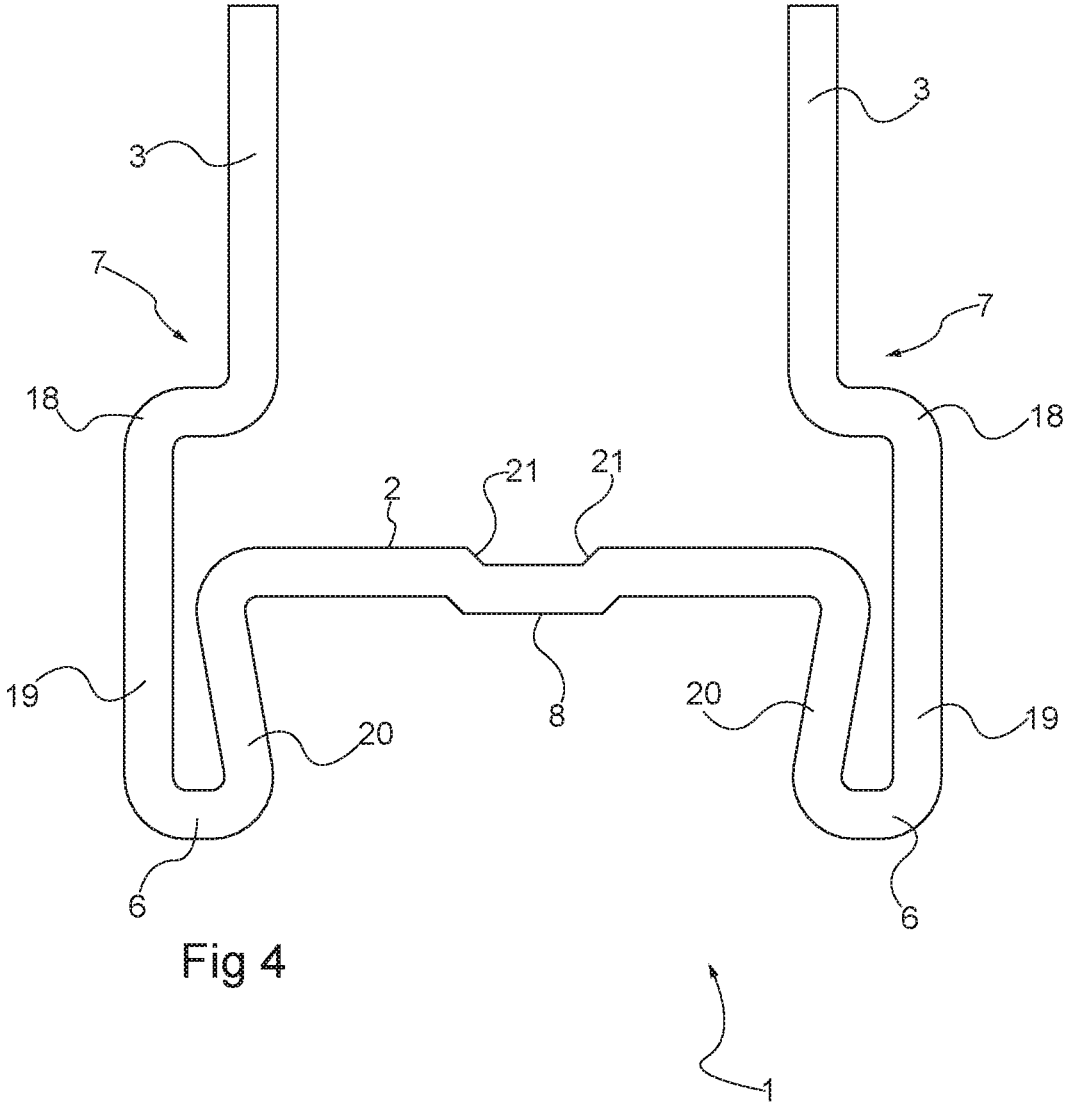
FIG. 4 is a cross-sectional view of the hang standard according to FIG. 1.

FIG. 4 discloses the cross-section of the hang standard 1 in detail. The leg portions 3 are straight and extend rearwards towards the wall, as seen in a mounted position. The distance between the leg portions 3 approximately corresponds to the width of the front portion 2, thereby providing the hang standard 1 with an approximately U-shaped cross-section, comprising the front portion 2 and the leg portions 3. At the forward end of the respective leg portion 3, as seen in a mounted position, there is a transition portion 7. From each transition portion 7, a protruding portion 6 extends forward, together framing the front portion 2 on both sides thereof.

Each protruding portion 6 has an outer wall 19 and an inner wall 20. In the example of FIG. 4, the outer wall 19 is approximately parallel with the leg portions 3, but preferably arranged at a distance therefrom, so that the hang standard 1 is wider when measured across the protruding portions 6 than across the leg portions 3.

In a representative example of this embodiment, each inner wall 20 is arranged at an angle to the adjacent outer wall 19. The angle is sharp, preferably no more than 15°, more preferably in the range of 3-12°, and in the example shown in the figures, the angle is approximately 10°. The slanting inner walls 20 form the recess 5 with the front portion 2. The recess 5 will hereby be slightly undercut, which may make it suitable for snap fastening of various components in the storage system. If brackets 11 of a conventional type are connected to the hang standard 1, the slanting inner walls 20 may also contact the lateral sides of the brackets 11, thereby providing additional stability to the mounted brackets.

In addition, the small angle between the outer 19 and the inner 20 walls may make the protruding portion 6 perform as if it were double walled. This may provide the hang standard 1 with properties like those of an I-beam. Its flexural rigidity and bending stiffness will be greater than those of a hang standard with a basic U-shape found in the prior art.

In the middle of the front portion 2, the longitudinal rib 8 is arranged between the columns of slots 4 (not shown in FIG. 4), as described above. In FIG. 4 it is clearly visible that the rib 8 comprises two parallel bends 21 of the sheet metal, resulting in the raised, longitudinal rib 8.

At each transition portion 7 between the leg portion 3 and the outer wall 19 of the protruding portion 6, a ledge 18 is formed due to the protruding portion 6 extending laterally outwards to a higher degree than the leg portion 3. The ledge 18 may be utilized for holding a screen or board in place between two hang standards 1 that are arranged next to one another, for instance. The screen or board may be slid in place from above or it may be snapped into its position by a slight bending thereof. As another alternative, the screen or board may be held in its position with one lateral edge next to a first hang standard 1, while a second hang standard 1 is slid sideways, along a rail 13, into its final position next to the other lateral edge of the screen or board. If needed, the screen or board may be utilized for covering the rails 13, other rails, electricity wires, pipes for water or heating etc.

Figure 5A:
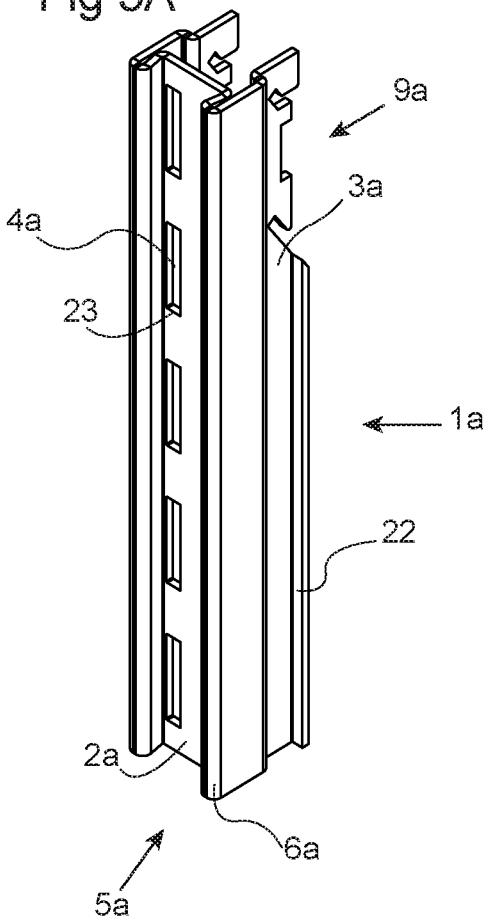
FIG. 5A is a diagrammatic view in perspective of another embodiment of the hang standard.
Figure 5B:
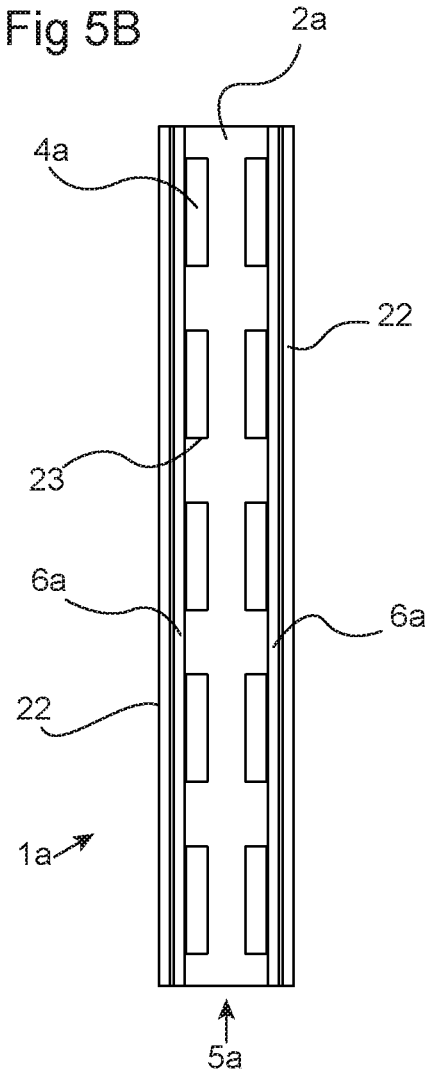
FIG. 5B is a planar view of the hang standard according to FIG. 5A.
Figure 5C:
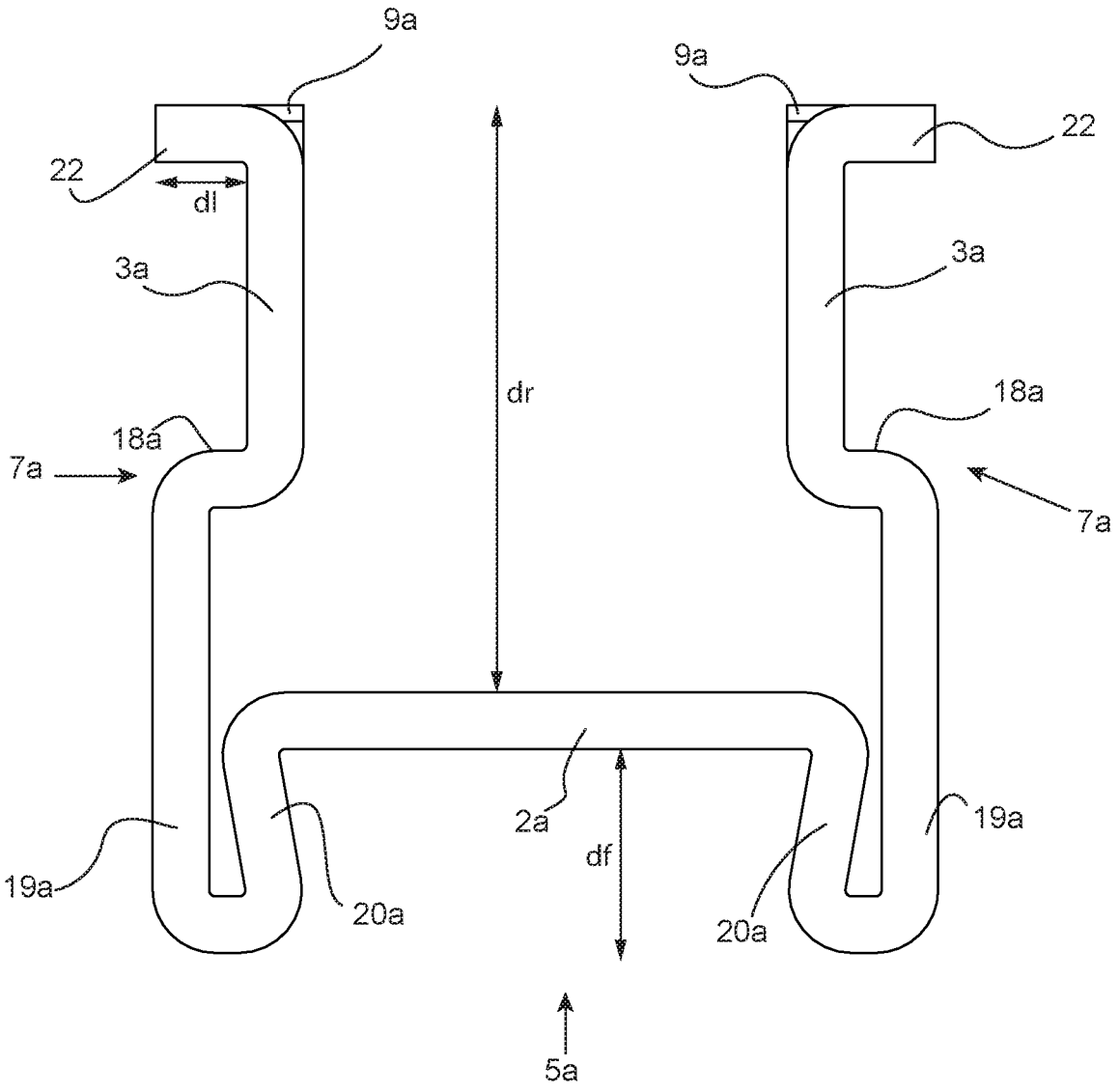
FIG. 5C is a cross-sectional view of the hang standard according to FIG. 5A.

FIGS. 5A-5C discloses another embodiment 1*a* of the hang standard. Like the embodiment described above, the hang standard 1*a* has a front portion 2*a*, forming an inner surface of a recess 5*a*. The front portion is provided with slots 4*a*, which are rectangular in the embodiment shown in FIG. 5A.

The outer 19*a* and inner 20*a* walls of the protruding portions 6*a* are similar to those of the previously described embodiment, and transition portions 7*a* are provided between the protruding portions 6*a* and leg portions 3*a*. Ledges 18*a* are formed at the transition portions 7*a*. Engagement devices 9*a*, in the form of sockets, for engagement with a (not shown) horizontal rail are provided in the leg portions 3*a*, as described above, as seen in FIG. 5C.

In the embodiment of FIG. 5A, the leg portions 3*a* are provided with longitudinal flanges 22 at their rear ends, for abutment against a wall, when the hang standard 1*a* is arranged in its mounted position. The longitudinal flanges 22 extend laterally outwards from the centre of the hang standard 1*a*. When the hang standard 1*a* is mounted, they may bear or rest against the wall. With potentially no sharp edges in contact with the wall, the risk of damage to the surface of the wall is reduced.

Further, the provision of the longitudinal flanges 22 may increase the flexural rigidity of the hang standard 1*a*, so that higher loads may be carried by the hang standard 1*a* without the risk of damage thereto. The increased strength of the hang standard 1*a* may be due to having a cross-section like that of an I-beam.

In FIG. 5B, it may be clearly seen that the slots 4*a* are rectangular, meaning that they have a lower edge 23 extending along a straight line. When a bracket 11, etc., is mounted in such a slot 4*a*, the load 12 carried by the bracket 11 may be distributed over all of the lower edge 23 thereby increasing the load carrying capabilities of each slot 4*a* and minimizing the risk of deformation thereof. The risk of deformation of the hang standard 1*a* as a whole may also be reduced. As a further embodiment, rectangular slots 4*a* may be provided in the hang standard 1 described above in connection with FIGS. 1 to 4.

It may also be seen in FIG. 5B that there is no rib 8 between the columns of slots 4*a*. The provision of a rib 8 may be seen as optional and depending on the thickness of the sheet metal used for the manufacture of the hang standard 1*a*. In some embodiments, a thinner sheet metal may be used, and a rib 8 may be provided as a feature in hang standards 1*a*, which otherwise have the rest of the features of the embodiment shown in FIGS. 5A-5C. If a rib 8 is provided, a sheet metal with a thickness of 1.2-1.5 mm may be used, whereas if a sheet metal with a thickness of 1.6 mm and over is used, the rib 8 may be dispensed with.

To fully illustrate the disclosed embodiment, a cross-sectional view is shown in FIG. 5C. Some features distinguishing between this embodiment and the embodiment of FIG. 4 include, as mentioned above, the longitudinal flanges 22 and the absence of the rib 8 in FIG. 5C. These distinguishing features may be separated from their respective embodiments and may be freely combined with the other features in the explicitly disclosed embodiments to form further embodiments.

As illustrated in FIG. 5C, the protruding portions may protrude a distance "df" in front of the front portion 2*a*. Typically, this distance may be in the range of 4-10 mm, in the illustrated case, 6.5 mm. The longitudinal flanges 22 may extend a distance "dl" laterally, typically in the range of 2-6 mm, and in the illustrated case, about 3.0 mm. The depth "dr" of the hang standard between the front portion 2*a* and the wall or the like may typically be 14-22 mm, in the illustrated case about 19 mm. This gives a sufficient strength with some margins in the case where the goods thickness of the sheet metal is about 1.6 mm.

The foregoing description is of exemplary and preferred embodiments. The invention, as defined by the appended claims, is not limited to the described embodiments. The embodiments are, unless otherwise noted, non-limiting examples of one or more inventive features. Alterations, modifications, and substitutions can be made to the disclosed embodiments by persons of ordinary skill in the art without departing from the invention as defined by the appended patent claims.

The meaning of the terms used in this specification are, unless stated otherwise, intended to have their ordinary and customary meaning to those in the art and are not intended to be limited to specific implementations that may be described. In the claims, the word "comprising" does not exclude other elements or steps, and the indefinite article "a" or "an" does not exclude a plurality.

What is claimed is:

1. A hang standard for mounting vertically in a storage system and connecting with cantilevered brackets, the standard being elongated along a center axis and having an approximately U-shaped cross-section, the hang standard comprising:

a first rearward extending leg portion and a second rearward extending leg portion for abutting a vertical surface when the hang standard is placed against the vertical surface; and a front portion having a plurality of connection points for connecting cantilevered brackets; wherein the front portion comprises:

a first protruding portion and a second protruding portion that define between them a continuous recess, and a plurality of slots arranged into two columns within the recess to define the plurality of connection points, with the first protruding portion and the second protruding portion located on opposite sides of the two columns of slots and the recess extending laterally between the first protruding portion and the second protruding portion over the two columns of slots; and wherein the hang standard further comprises two extending ledges between the front portion that are formed by a narrowing of the hang standard behind the front portion where the first protruding portion and the second protruding portion transition to the first leg portion and the second leg portion, respectively, each of the two ledges extending inwardly toward the center axis.

2. The hang standard of claim 1, wherein each of the rearward extending leg portions has a longitudinal flange arranged on an end of the leg portion, the flange extending outwardly from the center axis and configured to abut the vertical surface when the hang standard is placed against it.

3. The hang standard of claim 1, wherein the standard is formed in a single piece from a strip of sheet metal.

4. The hang standard of claim 1, wherein each protruding portion comprises an outer lateral wall facing away from the front portion and an inner lateral wall facing towards the front portion formed by single piece of sheet metal bent into a double layer.

* * * * *